United States Patent [19]

Larson

[11] 3,995,126

[45] Nov. 30, 1976

[54] MEMBRANE KEYBOARD APPARATUS

[75] Inventor: Willis August Larson, Mequon, Wis.

[73] Assignee: Magic Dot, Inc., Minneapolis, Minn.

[22] Filed: Apr. 3, 1975

[21] Appl. No.: 564,912

[52] U.S. Cl. ..... 200/5 A; 200/159 B; 200/340

[51] Int. Cl.² ..... H01H 13/00

[58] Field of Search ..... 200/5 R, 5 A, 1 CA, 200/83 N, 159 B, 243, 284, 308, 340, 86 R, 85 A

[56] References Cited

UNITED STATES PATENTS

| | | | |
|---|---|---|---|
| 2,262,777 | 11/1941 | Roper | 200/159 B |
| 3,304,386 | 2/1967 | Shlesinger | 200/83 N |
| 3,591,749 | 7/1971 | Comstock | 200/159 B X |
| 3,684,842 | 8/1972 | Boulanger | 200/159 B X |
| 3,731,014 | 5/1973 | Brady | 200/5 A |
| 3,742,157 | 6/1973 | Leposavic | 200/159 B X |
| 3,749,859 | 7/1973 | Webb et al. | 200/159 B X |
| 3,796,843 | 3/1974 | Durkee et al. | 200/159 B X |
| 3,806,673 | 4/1974 | Boulanger | 200/159 B X |
| 3,860,771 | 1/1975 | Lynn et al. | 200/340 X |
| 3,862,382 | 1/1975 | Glaister et al. | 200/5 |

*Primary Examiner*—James R. Scott

*Attorney, Agent, or Firm*—James L. Kirschnik; John P. Ryan

[57] ABSTRACT

Membrane keyboard apparatus is disclosed including an insulator having a conductive sheet thereon providing a plurality of first electrode members in the form of an array of apertures, and a plurality of second electrode members located concentrically within and spaced from the periphery of the apertures of the first electrodes to form an array of individual switching units. The height of the conductive sheet is greater than the height of the second electrode members whereby the level of the top surfaces of the plurality of first electrode members is vertically spaced above the level of the top surfaces of the second electrode members. A flexible, conductive member is disposed in a spaced relation above and adjacent to the level of the top surfaces of the pluralities of first and second electrode members. An identification member having an array of indicia corresponding to the array of individual switching units is disposed in a spaced relation above and adjacent to the flexible conductor. A threshold member is included in the form of an array of elastic bubble members corresponding to the array of individual switching units and including air escape means for the bubble members to avoid problems with trapped air. The bubble members are actuable by the touch which causes the selected bubble member to be deflected into the flexible conductive member to provide a conductive path between the associated first and second electrode members of the underlying switching units.

9 Claims, 5 Drawing Figures

MEMBRANE KEYBOARD APPARATUS

BACKGROUND

The present invention relates generally to switches, specifically to switches actuable by touch, more specifically to membrane switches, and more particularly to membrane switch keyboard apparatus.

Increased interest in electronic apparatus having switch keyboards, such as calculators, typewriters, and similar apparatus, has increased the need for keyboard apparatus. Such keyboard apparatus should include a minimum number of components which can be easily manufactured and which lend themselves to mass production techniques thus reducing the costs of materials and labor. Such apparatus should include a member for providing a feedback to the operator and for providing a switch threshold, with the apparatus being sensitive to actuation while simultaneously preventing a multiple closure of the switch.

SUMMARY

The apparatus of the present invention solves these and other problems in keyboard apparatus by providing, in the preferred embodiment, membrane keyboard apparatus including a plurality of first electrode members and a plurality of second electrode members forming an array of individual switching units on a face of an insulator. The height of the top surface of the plurality of first electrode members is vertically spaced from the height of the top surface of the plurality of second electrode members. A bridging member is disposed in a spaced relation above and adjacent to the level of the top surfaces of said electrode members. A member actuable by the touch of an operator provides a switch threshold through an array of bubble members. The bubble members can be individually deflected by the touch of the operator to cause deflection of the bridging member to thus provide a conductive path between the associated first and second electrode members of the individual switching unit selected.

It is a primary object of the present invention to provide novel membrane keyboard apparatus.

It is an object of the present invention to provide such membrane keyboard apparatus which includes a minimum number of components.

It is a further object of the present invention to provide such membrane keyboard apparatus which is simple in design, easy to manufacture, lends itself to mass production techniques, and which maximizes utilization of the materials used.

It is a further object of the present invention to provide such membrane keyboard apparatus which provides a switching threshold.

It is a further object of the present invention to provide such membrane keyboard apparatus which is sensitive to actuation.

It is a further object of the present invention to provide such membrane keyboard apparatus in which the possibility of a multiple closure of the switch is greatly reduced.

It is a further object of the present invention to provide air escape means in the switching threshold to enhance the sensitivity of actuation.

These and other objects and advantages of the present invention will become clearer in the light of the following detailed description of an illustrative embodiment of this invention described in connection with the drawings.

All figures are drawn for ease of explanation of the basic teachings of the present invention only; the extensions of the figures with respect to number, position, relationship, and dimensions of the parts to form preferred embodiment will be explained or will be within the skill of the art. The exact dimensions and dimensional proportions to conform to specific force, weight, strength, and similar requirements will likewise be within the skill of the art.

DESCRIPTION

Figure 1:
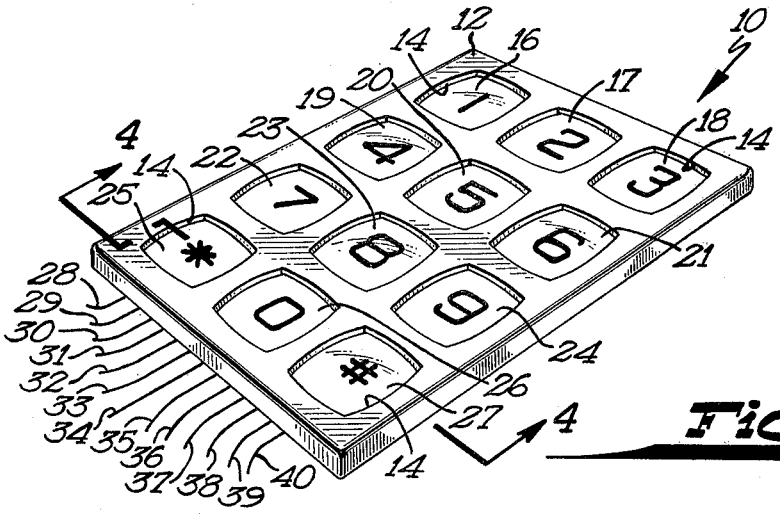
FIG. 1 shows a perspective view of membrane keyboard apparatus according to the present invention, shown including a bezel.

In FIG. 1, a preferred form of membrane keyboard apparatus is generally designated 10. Keyboard 10 includes a plastic molding or bezel member 12 having a plurality of apertures 14 formed therein exposing an array of individual switching units 16–27 therethrough. Switching units 16–27 are actuable by an input signal from the touch of a user and provide an electrical output signal, through electrical leads 28–40, for use with electric circuits, not specifically shown.

Figure 4:
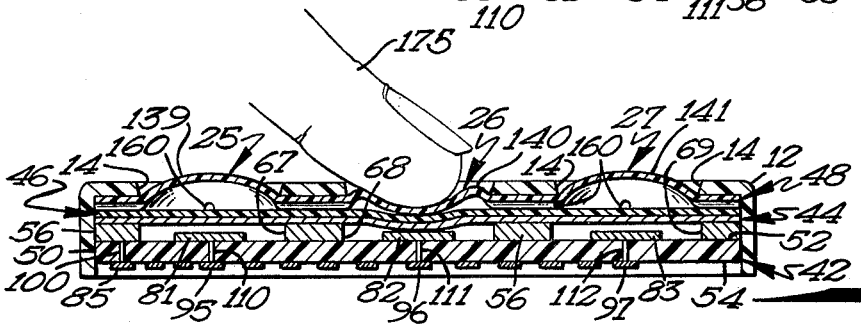
FIG. 4 is a cross sectional view of the apparatus illustrated in FIG. 1 along the planes of the section lines 4—4 of FIG. 1, with a individual switching unit shown as being actuated by a finger.
Figure 3:
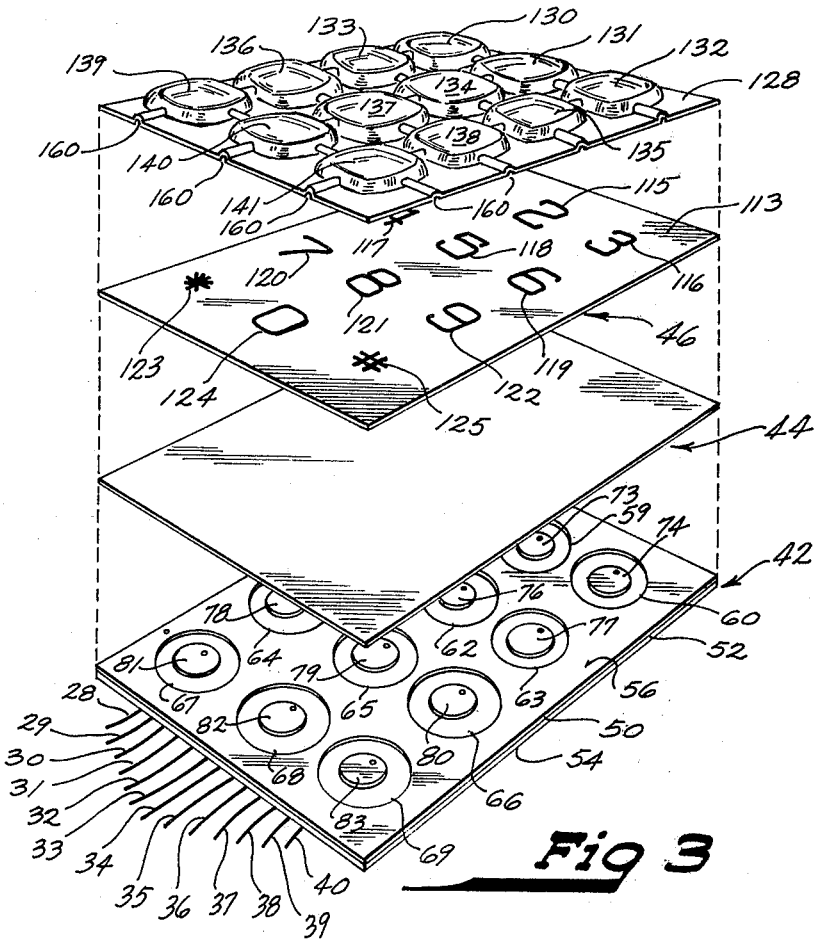
FIG. 3 is an exploded perspective view of the components of the apparatus illustrated in FIG. 1, omitting a bezel.

As best seen in FIGS. 3 and 4, keyboard 10 further includes an insulator component 42, a bridging member 44, an identifying member 46, and a threshold member 48. Insulator component 42 includes an insulator 50 having a first, top surface or face 52 and a second, bottom surface or face 54, a conductive sheet 56 of substantial area covering the first face 52 of insulator 50 having an array of apertures 58–69 formed therethrough to expose face 52 of insulator 50. The material of conductive sheet 56 located around apertures 58–69 form a plurality of first electrode members which are electrically connected to each other by the remaining material of sheet 56. Insulator component 42 supports a plurality of second electrode members 72–83 located on face 52 of insulator 50 concentrically within and spaced from the periphery of apertures 58–69 electrically insulated, from the first electrode members. Electrode members 72–83 and sheet 56 can be formed on insulator 50 by any suitable method such as by etching, plating, or other known methods.

Figure 2:
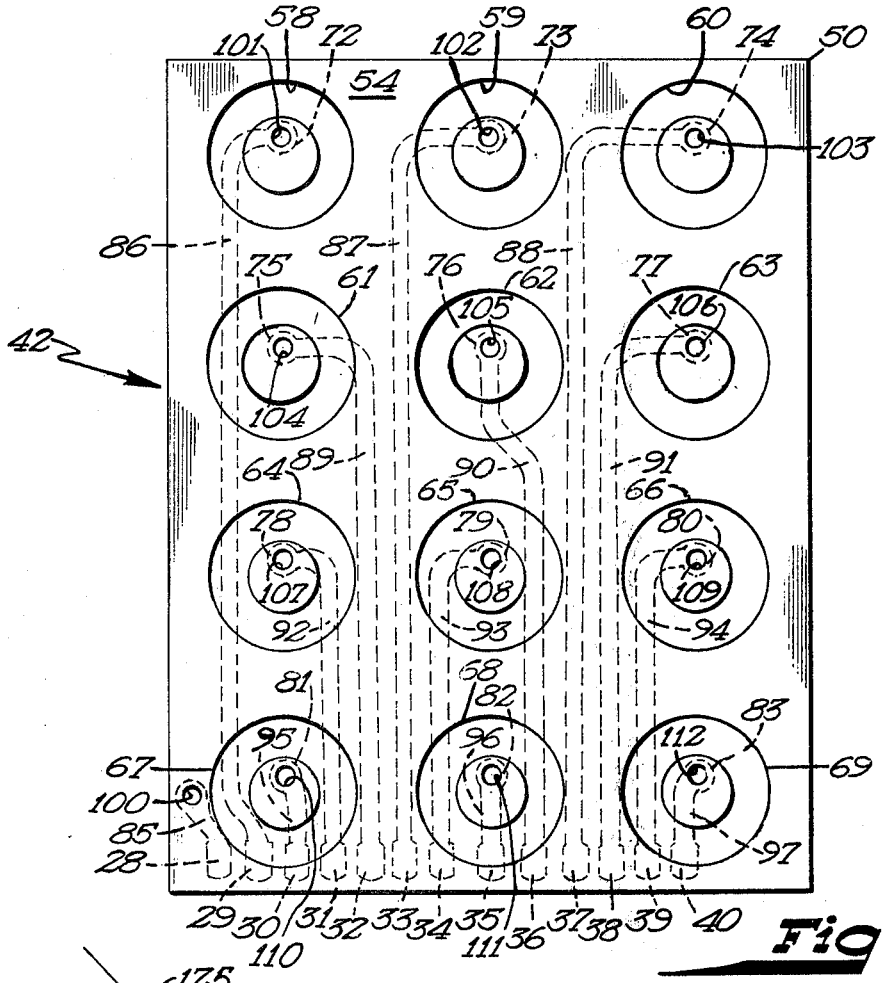
FIG. 2 is a top view of the insulator component of the apparatus illustrated in FIG. 1.

As best seen in FIG. 2, printed conductors 85–97 are formed on bottom surface 54 of insulator 50, and leads 28–40 can electrically interconnected to printed conductors 85–97 by suitable means such as by soldering.

In the preferred embodiment, insulator 50 is of a thickness substantially equal to 0.062 inches (0.15748 centimeters). The thickness of conductive sheet 56 and electrode members 72–83 is substantially equal to between 2 and 5 mils (0.00508 and 0.01270 centimeters.)

As best seen in FIG. 4, the thickness of second electrode members 72–83 is less than the thickness of sheet 56 and hence of the first electrode members such that the height of the top surfaces of the plurality of first electrode members is vertically spaced above the height of the top surfaces of the plurality of second electrode members 72–83.

Second electrode members 72–83 are electrically interconnected to printed conductors 86–97, respectively, located on bottom surface 54 of insulator 50 by electrical connections 101–112, respectively, which pass through insulator 50. Sheet 56 is electrically connected to printed conductor 85 located in bottom surface 54 of insulator 50 by electrical connection 100 which passes through insulator 50.

Electrical connections 100–112 can be formed by any suitable method such as a hole through insulator 50 interconnecting with sheet 56 and electrode member 72–83 by means of solder, plated through holes, conductive paste therethrough, or by pin members passing through insulator 50.

In the preferred embodiment bridging member 44 is a thin, flexible, sheet member having a high strength to mass ratio and formed of conductive material of a thickness substantially equal to 3 to 5 mils (0.00762–0.01270 centimeters). For example, member 44 may be formed of a light metal material or metallic foil such as sheet brass. Bridging member 44 is disposed in a spaced relation above and adjacent to the level of the top surfaces of the pluralities of first electrode members and second electrode members 72–83. As seen in FIG. 4, bridging member 44 is supported by and rests on sheet 56 of insulator component 42 and is spaced from but adjacent to second electrode members 72–83 to electrically separate bridging member 44 and sheet 56 from second electrode members 72–83. Bridging member 44 should be of sufficient rigidity and have sufficient strength to mass ratio so as to prevent bridging member 44 from sagging and contacting second electrode members 72–83, even after a multitude of forcible deflections, yet it should be sufficiently flexible so as to be sensitive to actuation by deflection thereof.

Identifying member 46 is formed of a flexible, nonconductive sheet 113, such as Mylar plastic film. An array of indicia 114–125, such as numerals or symbols, corresponding to the array of switching units 16–27 is formed thereon, for example, by silk screening. Member 46 rests on and is supported by bridging member 44.

Threshold member 48 is formed of a flexible, nonconductive sheet 128, such as Mylar plastic film, having an array of bubble members 130–141 corresponding in position to the array of switching units 16–27. Bubble members 130–141 are shown in a first preferred form as being domed shaped and are deflectible into member 46 and member 44 to cause deflection thereof such that bridging member 44 provides at least a conductive path between the associated first and second electrode members of the individual switching unit selected. Threshold member 48 requires a sufficient threshold force be placed on bubble members 130–141 to cause deflection thereof into members 44 and 46 before a conductive path will be provided by bridging member 44 between the associated first and second electrode members of the individual switching unit selected.

The amount of force necessary for deflection of bubble members 130–141 will depend on several factors including the thickness of the threshold member 48, the height of the bubble, the diameter of the bubble, the shape of the bubble, the material forming threshold member 48, and other factors. For example, the dome shaped of bubble shown in FIGS. 1, 3, and 4 having a height of 0.03 inch (0.0762 centimeters) and a diameter of 0.5 inch (1.270 centimeters), has been found to have a threshold of between 5 to 6 ounces for a threshold member 48 thickness of 5 mils (0.0127 centimeters).

Upon deflection, bubble members 130–141 may further provide a feedback to the operator in the form of a touch sensation felt the operator and/or in the form of an audible signal if bubble members 130–141 have a shape and sufficient height to allow them to snap through before actuating the individual switching units 16–27.

In the preferred embodiment, individual switching unit 16 includes: a first electrode member formed by the material located around aperture 58 of sheet 56 which is electrically interconnected to lead 28 by electrical connection 100 and printed conductor 85; second electrode member 72 which is electrically interconnected to lead 32 by electrical connection 101 and printed conductor 86; the portion of bridging member 44 located above and surrounding aperture 58 of sheet 56; indicia 114 of identifying member 46; and bubble member 130 of threshold member 48. The remaining individual switching units 17–27 are similarly formed by their associated first electrode member, second electrode member bridging portion, indicia, and bubble member.

The total force required to actuate individual switching units 16–27 is equal to the threshold force created by bubble members 130–141 plus the force necessary to deflect member 44 and member 46 into bridging connections between the first electrode members and second electrode members 72–83.

An alternate shape of bubble member (not shown) can be provided whereby the construction does not provide a snap-through action but rather will only provide a switch threshold. One such construction envisions a structure with sharply rising side walls and a substantially planar top. A bubble of this structure will provide deflection without an accompanying snap through action.

Means are provided for allowing air to escape and be distributed from the particular deflected bubble member. A preferred form is best seen in FIGS. 3 and 4 as air tunnels 160 in FIG. 4 which intersect with bubble members 130–141 allowing the air to escape from the individual bubble members selected, for example, bubble member 140 as shown in FIG. 4, and distribute the air to the remaining bubble members. Air tunnels 160 are particularly desirable when it is desired to have a sealed type keyboard apparatus.

Figure 5:
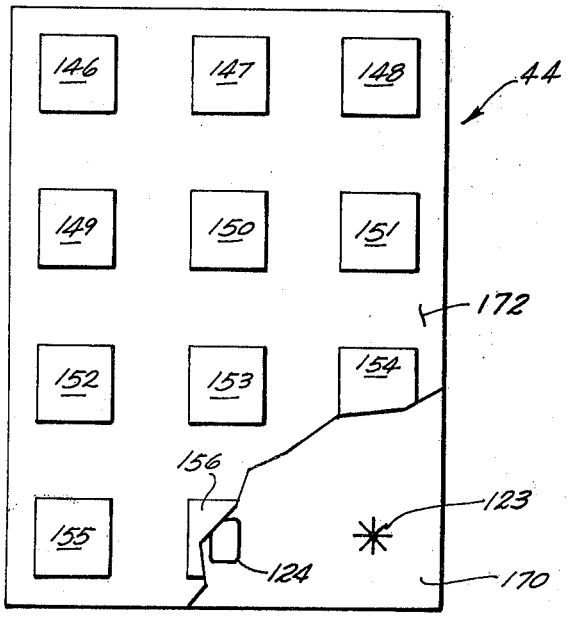
FIG. 5 is a bottom view of a modified member of the apparatus illustrated in FIG. 1.

An alternate embodiment of bridging member 44 is shown in FIG. 5. Bridging member 44 of FIG. 5 includes an identification member formed integral therewith. Bridging member 44 of FIG. 5 includes a flexible sheet member 170 of nonconductive material such as Mylar plastic film. An array of indicia 114–125, such as numerals and symbols, corresponding to the array of switching units 16–27 is formed on sheet member 170 such as by silk screening. A colored background layer 172 is located on sheet member 170 over indicia 114–125. A conductive coating is located on layer 172. If the conductive coating is a layer covering the entire bottom surface of member 170, it may be desired to omit background layer 172. In the preferred embodiment, the conductive coating is in the form of an array of patterned areas 146–157 corresponding to the array of individual switching units 16–27. Patterned areas 146–157 allow switch 10 to include several other switch functions such as sequential switching, isolated contact type switching, multiple contacts which are isolated, and other such switch functions. Further, printed membranes can be manufactured at a reduced cost and have a longer switching life.

In the preferred embodiment, the nonconductive sheet 170 is formed of Mylar and is of a thickness substantially between 3 to 10 mils (0.00772–0.0254 centimeters) and patterned areas 146–157 are formed from a resistive or carbonaceous paint (sometimes referred to as a semiconductive coating), or silver sprayed or screened on the Mular sheet 170 or layer 172 having a thickness of substantially 0.1 mils (0.000254 centimeters).

OPERATION

Generally, in operating the membrane keyboard apparatus 10, shown in FIGS. 1–4, the finger of an operator is placed upon a selected bubble member, of members 130–141, of switching units 16–27, for example, bubble 140 of switching unit 26 and finger 175 as best seen in FIG. 4. Pressure would then be placed on bubble 140 by finger 175, however bubble member 140 will not move sufficiently or will not move to cause deflection thereof into bridging member 44 until a force equal to the threshold force is placed on bubble member 140. For example, bubble member 140 may be of the type wherein the bubble member 140 will not deflect until a force equal to the threshold force is placed on bubble member 140 at which time, bubble member 140 would instantaneously collapse, deflecting into bridging member 44.

Previous switches known in the art, utilizing bubble members of a different variety, are subject to a phenomenon called multiple switch closure. Multiple switch closure occurs when the air within the bubble member deflected becomes compressed and causes the bridging member to deflect before the bubble member contacts the bridging member. Upon further deflection of the bubble member, the air within the bubble member is further compressed until the air can escape, as under the skirt of the bubble member, to release the bridging member. The bridging member would then return to its nonactuated position until the downwardly deflecting bubble member contacts it and again deflects the bridging member. The prior art switch thus is actuated for a short period of time by the compressed air, released, and reactuated by the operator thereby creating a spike output signal in the connected electronic circuits. Spike output signals can cause undesired signal damage to the electronic circuitry.

To avoid the phenomenon of multiple switch closure, one solution used by prior art switches is to make the bridging member thicker or less flexible material such that the bridging member will not deflect from the compressed air but only upon direct contact with the deflecting bubble member. However, such switches loose significant sensitivity because they required a very large force to deflect the bridging member. Utilizing a thick bridging member can also result in early switch failure, as when it is desired to have a very high bubble profile, for example in order to have a high switch threshold, the bubble can snap through but not sufficiently deflect the bridging member enough to electrically connect switch electrode members.

The present invention solves these problems in the known art by providing air escape and distribution means to allow the use of a high strength/low mass bridging member 44 formed of conductive material, as shown in FIG. 3, or of a Mylar sheet having a conductive coating, as shown in FIG. 5, such that the individual switching units 16–27 are very sensitive to actuation and have a greatly reduced possibility of multiple switch closure.

In the preferred form, the air escape and distribution means are air tunnels 160. As bubble member 140 is deflected, air escapes from the interior of the deflected bubble member 140 and to distribute to the interior of the remaining bubble members via air tunnels 160. Since the air is able to escape, bridging member 44 although very thin and flexible, will not deflect until such time as the bubble member 140 deflects into and directly contacts bridging member 44. Air tunnels 160 are especially useful when apparatus 10 is of a sealed type where it is not possible for the air or inert gas located within the interior of bubble members 130–141 to lift the skirt of threshold member 48 and escape into the atmosphere.

Upon continued deflection, a bubble member will contact identifying member 46 and bridging member 44 causing bridging member 44 to deflect into the associated first electrode, consisting of the material located around aperture of sheet 56, and into associated second electrode member of individual switching unit.

Therefore bridging member 44 provides at least a conductive path between the associated first and second electrode members of the individual switching units, for example in this case, switching unit 26, upon deflection thereof. It should be noted that in a first embodiment, bridging member 44 is a conductive sheet, as shown in FIG. 3. In a second embodiment, bridging member 44 is in the form of a nonconductive sheet having a conductive or a conductive undercoating layer. In the first and second embodiments, member 44 is electrically connected by its direct contact with the first electrode members of each individual switching unit 16–27. In the embodiment as shown in FIG. 5, in the form of patterned areas 146–157, each patterned area may be electrically insulated from every other patterned area, and the first and second electrode members of each individual switching unit may be electrically insulated from other individual switching units. This may be desired where the first electrode members are electrically insulated from each other, rather than electrically interconnected as shown.

When it is desired to provide only a switch threshold, bubble members 130–141 can be provided of the type having sharply rising side walls and planar top and the bubble member that will not snap through. However, when it is desired to provide a feedback in the form of a sensation felt by the operator and/or an audible signal, bubble members 130–141 can be provided of the dome type as shown in FIG. 4 in which it is necessary to deflect bubble members 130–141 over center before individual switching units 16–27 are actuated. Such bubble members 130–141 snap through thus distorting the bubble member deflected. The distortion can be felt by the operator, and if the distortions are of a proper shape, bubble members 130–141 may also give off a "snap" sound that can be heard by the operator. It should be noted that bubble members 130–141 of the dome shape as shown in FIG. 4 can be designed such that they do not snap through and thus provide only a switch threshold and not feedback to the operator or user of the keyboard.

When the operator removes his finger from bubble member the bubble member will return to its nonactuated position thus releasing member 46 and 44. The individual switching unit thus returns to an open switch position because bridging member 44 is electrically spaced and insulated from second electrode member.

It can now be appreciated membrane keyboard apparatus 10 of the present invention lends itself to mass production techniques. For example, to assemble apparatus 10, threshold member 48, identifying member 46, bridging member 44, and insulator component 42 are simply dropped into a bezel member 12, or for a sealed type switch, the edges of each component are glued together forming a unitary, sealed edge, and the sealed unit is dropped into bezel member 12.

Now that the basic teachings of the present invention have been explained, many extentions and variations will be obvious to one having ordinary skill in the art. For example, although twelve individual switching units 16–27 are shown and described, it will be apparent to one skilled in the art that apparatus 10 many optionally include more or few individual switching units.

Also, although a preferred embodiment of switch electrodes is shown and described, it will now be immediately apparent that other variations can be used, such as electrically insulated and isolated first electrode members, and multiple electrode members including various types of sequencing, encoding, or other switch features.

Furthermore, while two forms of bubble members are disclosed, variations from these forms are intended to be included, as defined in the appended claims. Also, while bubble members are shown having round peripheries, other shapes at peripheries, including square, rectangular, and others are within the skill of the art and are intended to be embraced, as defined, in the appended claims.

Likewise, the particular dimensions of the preferred embodiment are set out to particularly disclose the preferred and optimized embodiment thereof, and it is envisioned that once the present invention has been explained, other dimensions for the various parts of the present invention are within the skill of the art.

Although air tunnels 160 are shown in a first preferred pattern between bubble members 130–141, other patterns will be immediately apparent in the art including diagonal tunnels running from bubbles of different rows and different columns and are intended to be embraced, as defined, in the appended claims.

Since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

I claim:

1. A membrane keyboard apparatus for use in selectively activating two or more electrical circuits, said apparatus comprising:

an insulator having a first face;

two or more first electrode means supported on the first face of said insulator and having coplanar top surfaces in a first plane;

two or more second electrode means insulated from said first electrode means and supported on said first face of said insulator, said second electrode means having coplanar top surfaces in a second plane lying between said first plane and said first face of said insulator; said first and second electrode means defining an array of individual switching units;

conductive bridging means disposed adjacent to and supported on said first plane, said bridging means comprising a normally planar resilient sheet and being selectively deformable to form a conductive path between pairs of said first and second electrode means;

sheet means supported on said bridging means and including an array of resilient bubble members corresponding to said array of individual switch units and spaced from said bridging means whereby said bubble members may be deflected into said bridging means for providing a conductive path between said first and second electrode means, said sheet means having passageways formed therein for interconnecting the interiors of said bubble members; and means for electrically coupling said first and second electrode means to said electrical circuits.

2. Apparatus as defined in claim 1 wherein said sheet means is transparent and including indicia between said bubbles and said bridging means for visually differentiating said bubbles and their associated switching units.

3. A membrane keyboard apparatus for use in selectively activating two or more electrical circuits, said apparatus comprising:

an insulator having a first face;

first electrode means comprising a continuous sheet having at least two apertures formed therein and being supported on the first face of said insulator;

second electrode means supported on the first face of said insulator, said second electrode means comprising discrete electrodes within each of said apertures and being electrically insulated from said first electrode means, said first and second electrode means together defining an array of two or more individual switching units;

said first electrode means having a planar top surface lying in a first plane, and said second electrode means having coplanar top surfaces lying in a second plane intermediate said first plane and said insulator first face;

normally planar electrically conductive bridging means attached to and supported by said first electrode means in said first plane, said bridging means comprising a normally planar sheet being locally, resiliently deformable to form a conductive path between said first and second electrode means forming said switching units;

sheet means coupled to said bridging means and including an array of resilient bubble members spaced from said bridging means and corresponding to and adjacent said array of individual switching units whereby said bubble members may be deflected into said bridging means to provide a conductive path between said switching units;

said sheet means having passageways formed therein for interconnecting the interiors of said bubble members; and means for electrically coupling said first and second electrode means to said electrical circuits.

4. Apparatus as defined in claim 3 and including means for visually differentiating said bubble members.

5. The apparatus of claim 3 wherein the sheet means is formed of nonconductive material to electrically insulate the operator from the electrode means.

6. The apparatus of claim 3 wherein the bridging means comprises: a thin, flexible sheet member formed of conductive material.

7. The apparatus of claim 3 wherein the bridging means comprises a flexible sheet member of nonconductive material having a bottom surface and a conductive coating formed on the bottom surface of the nonconductive sheet member.

8. The apparatus of claim 7 wherein the conductive coating is patterned forming an array of conductive areas corresponding to the array of individual switching units.

9. The apparatus of claim 8 wherein the nonconductive sheet member is formed of Mylar plastic film.

* * * * *